United States Patent [19]

Prebeck

[11] Patent Number: 4,879,780

[45] Date of Patent: Nov. 14, 1989

[54] S-SHAPED JOINTER TOOL WITH SYMMETRIC BLADE AND HANDLE

[76] Inventor: Alfreda J. Prebeck, 38105 Reimold, Mt. Clemens, Mich. 48045

[21] Appl. No.: 329,458

[22] Filed: Mar. 28, 1989

Related U.S. Application Data

[63] Continuation of Ser. No. 111,853, Oct. 23, 1987, abandoned.

[51] Int. Cl.[4] ..... E04G 21/20

[52] U.S. Cl. ..... 15/105.5; 15/235.3

[58] Field of Search ..... 15/105.5, 235.3; 404/89; 425/458

[56] References Cited

U.S. PATENT DOCUMENTS

| | | | |
|---|---|---|---|
| 918,967 | 4/1909 | Close | 15/105.5 |
| 1,310,639 | 7/1919 | Thorson et al. | 15/105.5 |
| 1,327,151 | 1/1920 | Frazier | 15/235.3 |
| 1,436,254 | 11/1922 | Henry, Jr. | 15/105.5 |
| 1,445,021 | 2/1923 | Johnson | 15/105.5 |
| 1,683,373 | 9/1928 | Ross et al. | 15/105.5 |
| 1,715,569 | 6/1929 | Rathjen . | |
| 2,539,629 | 1/1951 | Knight | 15/235.5 |
| 2,883,854 | 4/1959 | Marmon | 15/235.5 |
| 3,109,189 | 11/1963 | Eldridge | 15/105.5 |
| 3,155,997 | 10/1964 | Gallagher | 15/105.5 |
| 3,403,419 | 10/1968 | Hazelrigg | 15/235.5 |
| 4,432,115 | 2/1984 | Fehler | 15/105.5 |

OTHER PUBLICATIONS

Catalog Sheet Entitled, "Quality Lightweight Masonry Tools", Frederick Tool Corp. 24630 Country Road 45, Elkart, Indiana 46516.

*Primary Examiner*—Harvey C. Hornsby
*Assistant Examiner*—Stephen F. Gerrity
*Attorney, Agent, or Firm*—Dykema Gossett

[57] ABSTRACT

An S-shaped jointer tool having two convexly arcuate sections serving as a working blade and handle. A circular segment cross-section produces a concave joint as the length of the working blade is moved along the joint being smoothed.

1 Claim, 1 Drawing Sheet

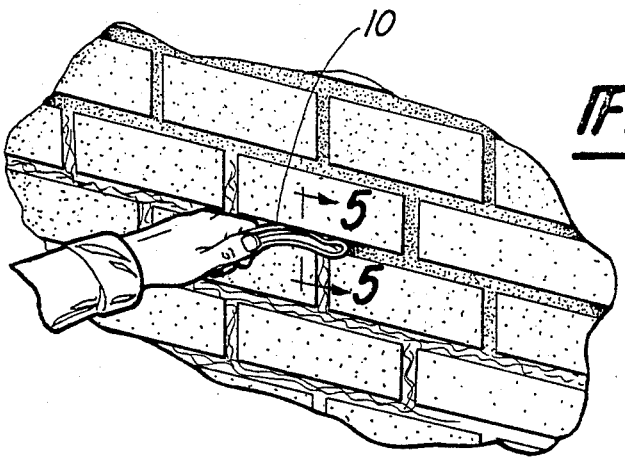
Fig-1
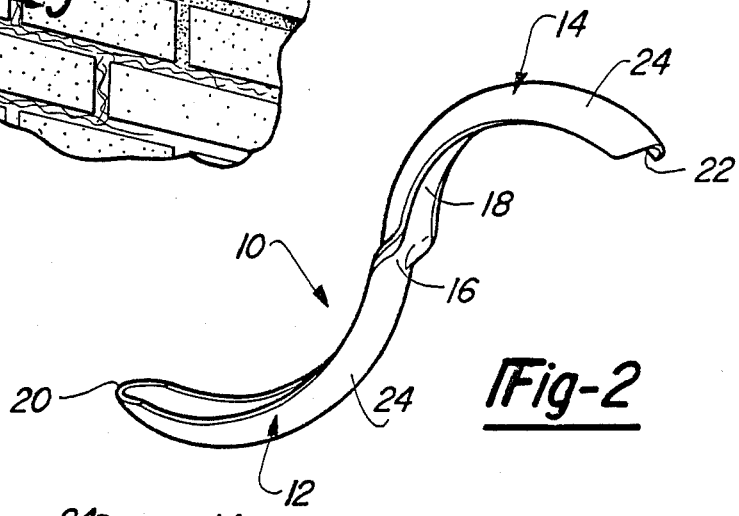
Fig-2
Fig-3
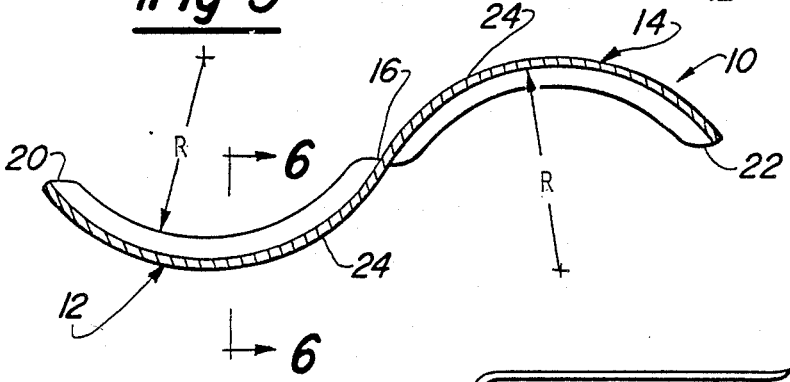
Fig-4
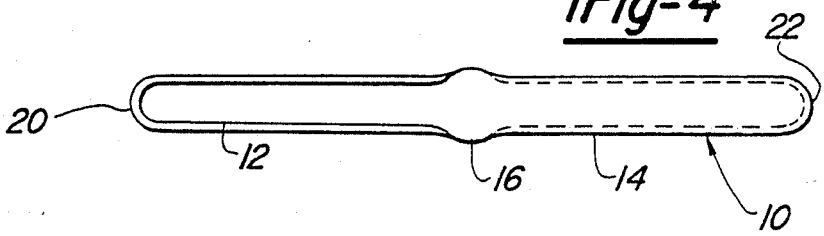
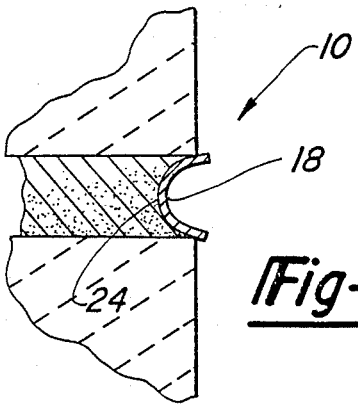
Fig-5
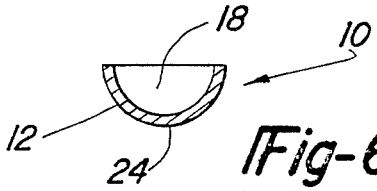
Fig-6

S-SHAPED JOINTER TOOL WITH SYMMETRIC BLADE AND HANDLE

This is a continuation of application Ser. No. 111,853, filed Oct. 23, 1987 (now abandoned).

BACKGROUND OF THE INVENTION

There are a variety of masonary tools or so-called jointers for smoothing mortar joints between rows of bricks or blocks which have been layed with cement or mortar seams. Some of the tools are designed to produce a single type of finish joint. The most common of these is a flat surface which can be a flush out producing a mortar joint flush with the brick or block surfaces or it can be a raked out joint which is recessed inwardly from the brick surface. These joints are generally produced by a straight surface at the end of a tool.

The tool also may be a combination tool in which, for example, there will be one surface for raking out a recess and another surface for smoothing the mortar joint which may be a flat surface or a concave joint surface.

Another type of tool is one which can produce a convex bead which can be functional or entirely for decorative purposes, that is, without an underlying joining seam.

Another type of tool can have a replacable working blade so that different types of blades can be used for different types of joints such as a flat strike or a concave joint or a V-joint. This type of tool may also allow for adjustment of the blade position so as to present another working surface when one surface becomes worn.

Still another type of tool is one that can have one or two blade surfaces that are tapered toward their free ends and they have a convexly curved straight surface so that that portion of the blade which is being used is selected from the decreasing width to accomodate the exact size of the seam being smoothed.

SUMMARY OF THE INVENTION

The present invention is directed to a tool designed to produce a single type of concave joint in which the working blade and handle are shaped so as to function either as a handle or a working blade to provide the added utility of a second wear surface for the working blade.

A jointer tool of this invention has a convexly arcuate working blade which has a uniform circular segment cross-section throughout its length. The handle extends tangentially outwardly from one end of the blade, and, preferrably it is constructed as a second convexly arcuate blade having a uniform circular segmented cross-section throughout its length. The two sections are tangent to each other at their juncture. This produces an S-shaped tool wherein one of the working blade sections may be of one size and the other section may be of another size to accomodate different joint configuations, or it may be of the same size but in any event, one section is grasped as a handle while the other section serves as the working blade surface.

One working surface faces in one direction while the other working surfaces faces in the other direction to form the S-shaped tool configuration, and the sections may be symmetrical to each other. The convexly arcuate section is preferrably a circular radius as well as the cross-section being a circular segment.

The combination of a convexly arcuate surface with the uniform circular segment cross-section throughout its length provides a unique tool and a new method of using a tool; namely, with a swinging, arcuate arm and wrist movement providing a smooth seam without retracing. Both ends of the tool are rounded at the end so that even if the wrist swing is continued to the end of the tool, the mortar joint is not irregularly indented.

BRIEF DESCRIPTION OF THE DRAWING

The objects of the invention are accomplished by the embodiments disclosed in the following description and illustrated in the drawings in which:

FIG. 1 is a perspective view showing the concave jointer tool of this invention being used to smooth a mortar joint of a brick wall.

FIG. 2 is a perspective view of the tool showing it in the form having identical working blade-handle sections.

FIG. 3 is a cross-sectional view of the tool and is specifically showing the circular radii of the convexly arcuate sections and their tangential juncture.

FIG. 4 is a plan view of the tool.

FIG. 5 is a fragmentary elevational view in cross-section showing the tool of this invention forming a concave surface joint.

FIG. 6 is a cross-section of the tool taken along line 6—6 of FIG. 3 showing the circular segment cross-section of the tool which is uniform throughout the length of both sections.

DETAILED DESCRIPTION OF A PREFERRED EMBODIMENT

Jointer tool 10 of this invention has a generally S-shaped configuaration with two convexly arcuate sections 12 and 14 joining each other tangentially at center 16 of the tool. The curve of the tool reverses at the center 16 so that sections 12 and 14 are symmetrical.

The arcuate sections 12 and 14 are circular sections having a common radius R. In some instances a different radius can be used for the two sections. The cross-section of the tool 10 is a circular segment 18 which is uniform throughout the length of both sections 12 and 14 from the center 16 to the ends 20 and 22 respectively which are rounded as best seen in FIG. 4.

The tool is preferably formed from 1050 cold rolled steel having a nominal thickness of 0.062" by a one step stamping die operation. The tool is tumbled in the presence of a rust inhibitor to remove any burrs and to give the tool a smooth surface. In the preferred form of the tool the radius R of the two convexly arcuate sections is $2\frac{3}{4}$" and the width of the tool is $\frac{3}{4}$". The overall length of the tool is approximately $9\frac{1}{4}$". While the two radii may be different as well as the radius of the circular segment cross-section to accomodate particular joints, with the overall dimensions described, a concave joint can be created with varying seam width.

The convex surfaces 24 of both tool sections 12 and 14 serve as the working blade of the tool and also as a handle. As best seen in FIG. 1, one section 12 or 14 is grasped in the hand of the user and the other section 12 or 14 is applied against the mortar joint to be smoothed. With the uniform arcuate working blade 24, the user may flex his wrist as he moves the tool along in an arcuate swing of his arm so that the point of contact moves along the surface 24 providing an even smooth joint. With the rounded ends 20 and 22 of the tool, the user may even finish his stroke at the end of the tool without marring the joint being smoothed. The overall S-shape of the tool with rounded ends and no sharp corners allows the user to store the tool in his pocket without the danger of tearing.

The embodiments of the invention in which an exclusive property or privilege is claimed are defined as follows:

1. A jointer tool for smoothing martar joints between rows of bricks:

said jointer tool being comprised solely by two identical but reversed convexly arcuate sections;

each section having an inner end and an outer end, said inner ends meeting and being directly connected to each other at a common point of tangency at a middle of the tool such that said sections form a pair of connected, continuously curved and oppositely placed smooth surfaces;

said inner ends including outwardly flared opposed arcuate side portions which extend laterally from the convexly arcuate sections;

each section having a uniform circular segment cross-section throughout its length;

each convexly arcuate section having an identical circular radius for forming an S-shaped tool with the sections being symmetrical to each other, but reversed, about said common point of tangency;

the outer end of each section is rounded so that a point of contact between the tool and mortar joint can reach an outer end of a section during pivoting of the tool without marring the mortar joint being smoothed;

said outer ends of said arcuate sections being disposed on a straight line passing through said common point of tangency;

such that each arcuate section of the tool is used as a handle and a working blade and said tool being pivoted by wrist movement of the user as the tool is swung in an arc so that the point of tool contact with a mortar joint being smoothed moves outward along the convexly arcuate section being used as a working blade toward the outer end of the section as the tool is moved along the joint.

* * * * *